United States Patent [19]

Couture

[11] Patent Number: 4,466,221

[45] Date of Patent: Aug. 21, 1984

[54] THERMAL BARRIER SKYLIGHT

[75] Inventor: Paul A. Couture, Emery Mills, Me.

[73] Assignee: Wasco Products, Inc., Sanford, Me.

[21] Appl. No.: 309,933

[22] Filed: Oct. 9, 1981

[51] Int. Cl.[3] ..... E04B 7/18

[52] U.S. Cl. ..... 52/200; 49/DIG. 1

[58] Field of Search ..... 52/200, 72; 49/DIG. 1

[56] References Cited

U.S. PATENT DOCUMENTS

| | | | |
|---|---|---|---|
| 3,005,291 | 10/1961 | Huber | 52/200 X |
| 3,473,276 | 10/1969 | Buck et al. | 52/200 |
| 4,388,784 | 6/1983 | Sentoft et al. | 52/200 |

FOREIGN PATENT DOCUMENTS

| | | | |
|---|---|---|---|
| 257900 | 10/1967 | Austria | 52/200 |
| 1088266 | 10/1980 | Canada | 52/200 |
| 2907343 | 9/1980 | Fed. Rep. of Germany | 52/200 |

*Primary Examiner*—Carl D. Friedman

*Attorney, Agent, or Firm*—Wolf, Greenfield & Sacks

[57] ABSTRACT

The skylight may be of the domed-type or flat-type and of single or double glass (acrylic or other transparent or translucent plastic) construction. The skylight fits within an opening in a roof or the like and has a peripheral base that may be constructed of a metal material such as aluminum, and which is fixed to the roof about the opening. The base comprises inner and outer base frames separated by a thermal break, a peripheral curb frame disposed over the base, and a retainer for securing the skylight cover over the curb frame. The curb frame or support frame has inner and outer sections connected by a heat insulating thermal barrier. The curb frame is constructed by welding at the corners of the support frame but eliminating the welding in the area of the thermal barrier thus alleviating a caulking operation at the top and the bottom of the curb frame. The base frame and curb frame have therebetween a compliant sealing means extending contiguously about and overlying the base frame and for sealing between the base frame and support frame.

17 Claims, 3 Drawing Figures

Fig. 2
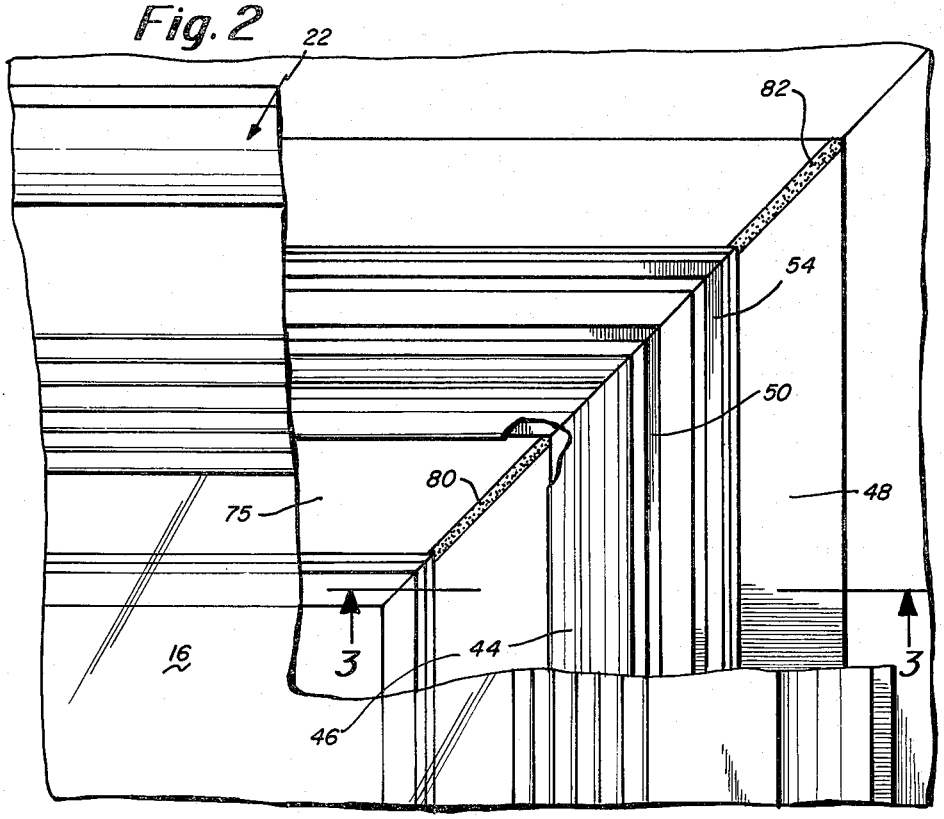
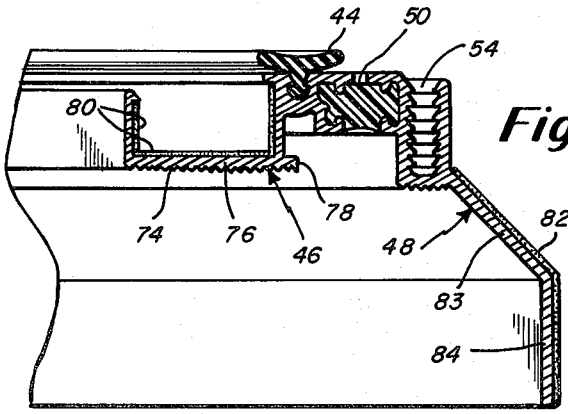
Fig. 3

THERMAL BARRIER SKYLIGHT

BACKGROUND OF THE INVENTION

The present invention relates in general to an improved skylight construction, and is concerned, more particularly, with an improved skylight construction characterized by an improved thermal barrier, a simplified manufacturing technique, and improved liquid drainage from the skylight.

In conventional skylight construction, particularly in the skylights for commercial use, the support frame is provided in inner and outer sections joined by a thermal break, which is typically formed by a poured and cured rigid urethane. This thermal break is for minimizing heat transfer through the skylight, and in particular through the heat conductive metal forming the skylight, such as an extruded aluminum. It is most efficient to form the thermal break as the aluminum is being extruded. For the skylight which requires corner mitre welds, the thermal break is essentially destroyed in the vicinity of the weld, and there results a burned-out hole or gap in the thermal break. This usually requires a separate step such as the application of caulking to close the seam and cover the burned thermal break material.

Accordingly, it is an object of the present invention to provide an improved skylight construction in which the thermal break material is not destroyed by welding so as to thus provide a continuous uniform thermal break. This is accomplished at least in part by eliminating the aluminum welding in the region of the thermal break material. This further has the benefit of eliminating the necessity of a caulking operation at the top and bottom of the frame. This further eliminates the unsightliness of the underframe caulking previously used and readily observed in the finished product when viewed with the frame in the open position.

Another object of the present invention is to provide a new and improved curb frame construction that provides a self draining channel overlying the base frame and the gasket disposed intermediate the base frame and curb frame. This is provided at least in part by providing a smaller height thermal barrier between the inner and outer sections of the curb frame.

Another object of the present invention is to provide a skylight construction that is characterized by being energy saving.

SUMMARY OF THE INVENTION

To accomplish the foregoing and other objects of this invention, there is provided a skylight construction adapted to be fitted into an opening in a building such as a commercial building. The skylight construction comprises a curb frame extending about the opening and having means for securing the frame in place about the opening. The translucent transparent means cover the opening and extend the edges to overlie the frame means. The covering means may comprise a pair of glass plates, or the covering means may also be in the form of one or two domes. A retainer extends about the periphery of the skylight for holding the panels on the curb frame. The frame means comprises a base frame and a support frame or curb frame overlying the base frame. The support frame and the base frame are preferably constructed of a metal material such as an extruded aluminum. The support frame has inner and outer sections connected by a heat insulating thermal barrier or thermal break. This thermal barrier may be a poured and cured rigid urethane. The retainer is secured to the outer section of the support frame. The base frame is provided in inner and outer frames that are preferably extruded aluminum with each being welded into a separate frame. A premolded gasket then forms a thermal break at the joint between the inner and outer frames. This gasket is preferably a premolded butyl tape having a neoprene shim embedded therein to maintain the separation between the inner and outer frames. The inner and outer frames may then be permanently fixed by means of riveting or the like. A hollow gasket is provided between the base frame and the support frame overlying the base frame. This gasket may be provided in prefabricated form such as in rectangular form corresponding to the shape of the skylight frame. The gasket is formed in a single piece mitred and vulcanized at the corners. In this way an optimum seal is achieved with there being total gasket continuity along with total thermal break continuity. With regard to the curb frame and its thermal barrier, the integrity of the thermal barrier particularly at the frame corners is maintained by eliminating the corner welds in the area of the thermal barrier. In this way an extra caulking operation at the top and bottom of the frame is eliminated. This thereby eliminates the unsightliness of such underframe caulking in the finished product when viewed with the frame in the open position. Also, in accordance with the present invention the support frame inner section has wall means which in part defines a condensation gutter underlying the glass plates. This wall means depends below the thermal barrier of the curb frame so as to space the base/support frame sealing gasket from the thermal barrier to provide a liquid leakage path from the support frame outwardly. The path extends from the gutter over the sealing gasket and intermediate the base and support frames.

BRIEF DESCRIPTION OF THE DRAWINGS

Numerous other objects, features and advantages of the invention should now become apparent upon a reading of the following detailed description taken in conjunction with the accompanying drawings, in which:

FIG. 2 is a top plan view at one corner of the skylight partially broken away to show in particular the corner welding technique; and FIG. 3 is a cross-sectional view taken along line 3—3 of FIG. 2 further showing the corner welds.

DETAILED DESCRIPTION

Figure 1:
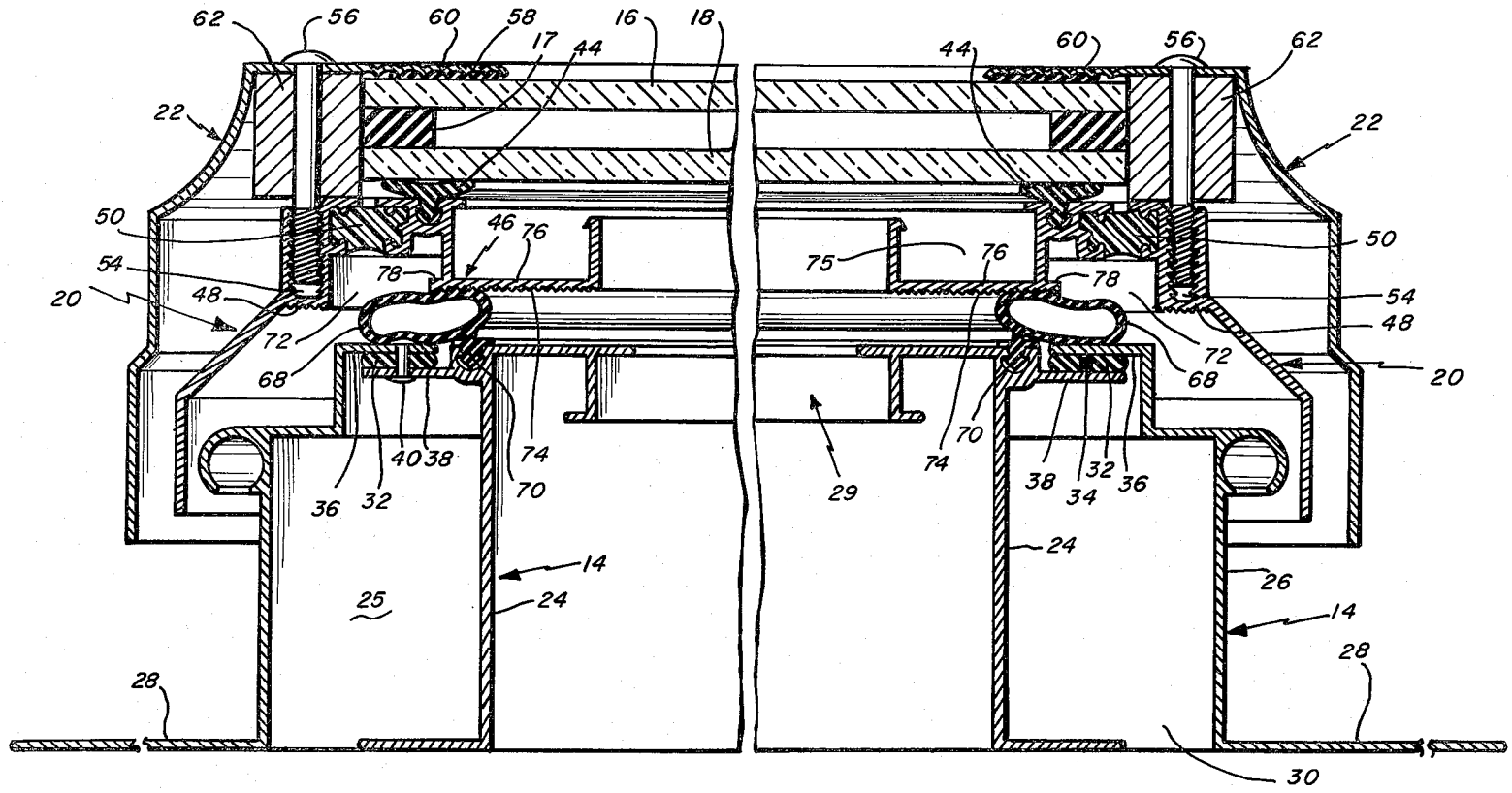
FIG. 1 is a cross-sectional view of a flat-type skylight construction embodying the principles of the present invention.

With reference now to the drawings, in FIG. 1 there is shown a cross-sectional view of a skylight which is of flat construction. FIG. 2 shows a broken away top plan view at a corner of the skylight. FIG. 3 is a detailed view taken along line 3—3 of FIG. 2 showing particularly the corner welds. The construction of FIG. 1 could also be used with a domed cover.

In the disclosed embodiment of FIG. 1, the skylight is of a flat construction, and it is adapted to span an opening which is generally of square or rectangular shape and may be defined by upright walls or by roof construction. The skylight construction shown in this first embodiment includes a pair of glass plates 16 and 18, a base frame 14, an overlying support frame 20, and a retainer 22. The two frames 14 and 20 along with the retainer 22 are preferably constructed of metal. The frames, in particular, may be constructed of a extruded aluminum.

The base frame 14 comprises basically two members including an inner frame 24 and an outer frame 26. These frames may be constructed separately in the form of an aluminum extrusion. These frames define an inner compartment 25 which may contain an insulating material such as a fiberglass insulation or a low density foam core. The outer frame 26 includes a flange 28 for attachment of the entire base frame to a roof construction or the like. The separate inner and outer frames comprising the base frame may individually be welded into separate frames. The inner frame 24 is open as indicated at 29 so that light may pass through the skylight.

In FIG. 1, the thermal break between the inner and outer base frames is formed by a gap 30 at the lower area between these inner and outer frames, and, also, by a premolded, tacky, butyl gasket or tape 32 having an embedded hard neoprene shim 34. The shim 34 is for maintaining a substantially constant separation between the leg 36 of outer frame 26 and the leg 38 associated with the inner frame 24. The inner and outer frames are then joined together by means of a series of pop rivets 40. Although these pop rivets are metallic, they have been found to not affect to any great deal the conductivity between the inner and outer frames.

The skylight glass plates 16 and 18 are supported over the intermediate support frame 20 by means of the retainer 22. The plates 16 and 18 are separated by a gasket 17 of a premolded butyl which may be in the form of a tape. The lower plate 18 rests upon a cup-shaped sealing gasket 44 which interlocks with the inner section 46 of the support frame 20. The support frame 20 also includes an outer section 48 with there being provided between the sections 46 and 48 a thermal break 50 which may be formed in a conventional manner. The thermal break 50 may be a poured and cured urethane with the urethane thermal break actually interlocking with the sections to maintain them integrally together. The outer section 48 also includes means defining a channel 54 for receiving a securing bolt 56. There are preferably a plurality of these securing bolts or screws that are employed for securing the retainer 22 over the glass plates.

In addition to the gasket 17, there is also provided a second butyl gasket or tape 58 disposed over the top of plate 16 and for sealing between the top surface of the plate 16 and the leg 60 of the retainer. The bolts 56 also pass through the leg 60 outwardly of the tape 58. At least some of the bolts or screws 56 also pass through a glazing stop 62. FIG. 1 shows two of these stops on opposite sides of the glass panels so as to hold these panels in place in a proper position with regard to the retainer.

The upper portion of the skylight construction may be considered as comprising the support frame 20, retainer 22, and glass plates 16 and 18. This entire assembly overlies the base frame 14. A latching arrangement (not shown) may be employed for holding the upper assembly over the base frame. The upper assembly may also be movable such as being tilted so as to at least partially open the skylight. In the closed position, the upper assembly is sealed to the base by means of the hollow gasket 68. This gasket is shown in a cross-section in FIG. 2. This gasket may be made of a rubber material and is preferably a foam rubber gasket having a leg 70 extending therefrom and engageable with a channel in the inner base frame 24. This interlocking of the leg 70 with the frame channel disposes the hollow gasket 68 in an overlying relationship intermediate the inner frame 24 and the outer frame 26. The gasket 68 essentially overlies the sealing butyl tape 32.

It is noted in FIG. 1 that the hollow gasket 68 does not bridge between the inner and outer sections of the support frame 20 as in our copending application Ser. No. 175,305. Rather, there is provided a self draining channel 72 defined over the gasket 68 which permits liquid drainage essentially about the thermal break, over the gasket 68 and to the outside. Thus, the hollow gasket 68 only contacts the inner section 46 of the support frame 20. More specifically, the gasket 68 contacts the textured lower surface 74 of the inner section 46. The surface 74 is defined on bottom wall 76 which forms the bottom of the condensation gutter 75. The textured lower surface 74 actually extends beyond the gutter slightly with the extension of a small flange 78. As indicated previously, there is no contact between the gasket 68 and the outer section 48 of the support frame 20. To provide a sufficient drainage channel 72 the thermal barrier 50 is made of a smaller height than previously.

Another feature of the present invention is illustrated in FIGS. 2 and 3. Rather than welding the inner and outer sections of the support frame at the corners entirely from inside edge to outside edge, the aluminum welding in the region of the thermal break material 50 has been eliminated. The areas in which it is preferred to have the weld are illustrated in FIGS. 2 and 3. Thus, the condensation gutter 75 has a weld 80 at the bottom and sides thereof. On the outside there is also provided a weld 82 which extends along the walls 83 and 84 of the outer section 48 of the support frame 20. This outer weld terminates just short of the bolt receiving channel 54 as clearly depicted in FIG. 3. This form of limited welding eliminates the burning of the material 50 which occurred previously when the weld extended from inner side to outer side at the corner. This burning caused an open seam from the top to the bottom of the frame through the material 50. This also eliminates the need for any caulking operation at the top and bottom of the frame 20 at the mitre corners. This further eliminates the unsightliness of the underframe caulking in the finished product when viewed with the frame in the open position.

In summary, the gutter area is totally welded to prevent water from getting inside of the skylight into the opening 29. The downward leg of the frame is also welded at 82 to give the unit strength. However, if by chance the downward leg is somewhat porous, this would simply let the water out which would not be any major problem. The basic intent is that there can actually be a leak through the frame 20 as long as it is beyond the gutter. The sealing barrier comes from the gasket 68 and the overlying welded gutter that sits on the gasket. Because of this construction, welding in the thermal break area is eliminated and because water can pass through this general area, caulking is not required.

Because of the absence of welding in the immediate vicinity of the thermal break material 50 particularly at the corner mitres, there may be moisture leakage but this will self drain through the channel 72 over the gasket 68 to the outside. Moreover, weepholes not shown in the drawings, may be provided from the gutter 75 to also permit liquid condensation drainage through the channel 72 to the outside.

What is claimed is:

1. A skylight construction for an opening in a building or the like comprising;

a frame means extending about the opening and including means secureable about the opening, translucent or transparent means covering the opening and extending at edges to overlie the frame means, means for retaining the covering means on the frame means, said frame means comprising a base frame and a support frame overlying the base frame, said support frame having inner and outer sections connected by a heat insulating thermal barrier, each said section including multiple pieces joined at corners of the support frame, means providing welding at said corners of the support frame including an interruption of the weld in the area of said thermal barrier so as to form a self-draining liquid path about the thermal barrier said base frame and support frame defining therebetween a continuation of the liquid path unobstructed to external of the frame means.

2. A skylight construction as set forth in claim 1 wherein said covering means includes at least one plate means.

3. A skylight construction as set forth in claim 2 including a pair of glass plates.

4. A skylight construction as set forth in claim 1 wherein said retaining means includes a retainer having one side extending downwardly about the base frame and another side extending inwardly to contact the edge of the covering means.

5. A skylight construction as set forth in claim 4 including securing means for securing the retainer to the support frame sandwiching the edge of the covering means between the support frame and the other side of the retainer.

6. A skylight construction as set forth in claim 1 wherein said base frame comprises an inner base frame and an outer base frame, said base frame being constructed of metal and separately formed of straight pieces to form individual frames and means defining a heat insulating thermal break between inner and outer frames.

7. A skylight construction as set forth in claim 6 wherein said thermal break includes a compressible tape having shim means to limit the separation between the inner and outer base frames.

8. A skylight construction as set forth in claim 7 wherein the inner and outer frames each include a leg, one leg overlying the other with the tape therebetween, and means securing the legs together.

9. A skylight construction as set forth in claim 1 including a cup-shaped gasket carried by the support frame and upon which the covering means rests.

10. A skylight construction as set forth in claim 1 including a compliant sealing means extending contiguously about and overlying the base frame and for sealing between the base frame and support frame.

11. A skylight construction as set forth in claim 10 wherein said sealing means comprises a hollow gasket.

12. A skylight construction as set forth in claim 10 wherein said support frame inner section has wall means depending below said thermal barrier and contacting the top of the sealing means so as to space said sealing means from said thermal barrier to provide a liquid leakage path from the support frame outwardly.

13. A skylight construction as set forth in claim 12 wherein said wall means in part defines a condensation gutter underlying said covering means, said path extending from said gutter over said sealing means and intermediate the base and support frames.

14. A skylight construction for an opening in a building or the like comprising;

a frame means extending about the opening and including means secureable about the opening, translucent or transparent means covering the opening and extending at edges to overlie the frame means, means for retaining the covering means on the frame means, said frame means comprising a base frame and a support frame overlying the base frame, said support frame having inner and outer sections connected by a heat insulating thermal barrier, a compliant sealing means extending contiguously about and overlying the base frame and for sealing between the base frame and the support frame, said support frame inner section having wall means depending below said thermal barrier and contacting the top of the compliant sealing means so as to space said sealing means from said thermal barrier and from said support frame outer section so as to provide a liquid leakage path from the support frame outwardly.

15. A skylight construction as set forth in claim 14 wherein said wall means in part defines a condensation gutter underlying said covering means, said path extending from said gutter over said sealing means and intermediate the base and support frames.

16. A skylight construction as set forth in claim 14 wherein each of the inner and outer sections of the support frame includes multiple pieces joined at corners of the support frame, and means providing welding at said corners of the support frame including an interruption of the weld in the area of said thermal barrier so as to form a self-draining liquid path about the thermal barrier.

17. A skylight construction for an open building or the like comprising;

a frame means extending about the opening and including means securable about the opening, translucent or transparent means covering the opening and extending at edges to overly the frame means, means for retaining the covering means on the frame means, said frame means comprising a base frame and a support frame overlying the base frame, and a compliant sealing means extending contiguously about and overlying the base frame and for sealing between the base frame and the support frame.

* * * * *